United States Patent [19]

Peterson

[11] 4,013,385

[45] Mar. 22, 1977

[54] DEEP WELL PUMP SYSTEM

[76] Inventor: Fred M. Peterson, 3232 Shawnee Trail, Fort Worth, Tex. 76135

[22] Filed: June 6, 1975

[21] Appl. No.: 584,484

[52] U.S. Cl. ..... 417/377; 92/85 B; 92/168; 417/378; 417/402

[51] Int. Cl.[2] ..... F04B 17/00

[58] Field of Search ..... 417/402, 245, 246, 383, 417/349, 323, 377, 378; 92/165, 168, 85 B

[56] References Cited

UNITED STATES PATENTS

| | | | |
|---|---|---|---|
| 1,616,773 | 2/1927 | Warren | 417/388 |
| 1,765,457 | 6/1930 | Shutt | 92/168 |
| 1,880,321 | 10/1932 | Jackson | 417/377 |
| 2,058,455 | 10/1936 | Huff | 417/378 |
| 2,072,403 | 3/1937 | Lausen | 417/377 |
| 2,180,366 | 11/1939 | Reichert | 417/378 |
| 2,384,173 | 9/1945 | Johnston | 417/377 |
| 2,486,617 | 11/1949 | Soberg | 417/378 |
| 2,527,184 | 10/1950 | Gerhold | 417/378 |
| 2,562,584 | 7/1931 | Soberg | 417/378 |
| 2,917,000 | 12/1959 | English | 417/401 |
| 2,938,466 | 3/1960 | King | 417/378 |
| 2,983,227 | 5/1961 | English | 417/377 |
| 3,838,945 | 10/1974 | Moore | 417/378 |

*Primary Examiner*—C. J. Husar
*Attorney, Agent, or Firm*—James C. Fails

[57] ABSTRACT

A deep well pump system incorporating a sub-surface pump unit and a surface power unit with a fluid column formed therebetween. The pump unit incorporates a counterbalance means that is specifically illustrated as a collapsible volume chamber operably engaged with a pump piston to cause a fluid pumping linear movement of the piston responsive to the selective contraction and expansion of the collapsible volume chamber. The power unit, in the charging stroke thereof, pressurizes the fluid column by the introduction of a volume therein sufficient to contract the collapsible volume chamber, with a subsequent pressure buildup effecting discharge of additional fluid from the power unit with less valving than the prior art pumps.

2 Claims, 7 Drawing Figures

Fig. 1
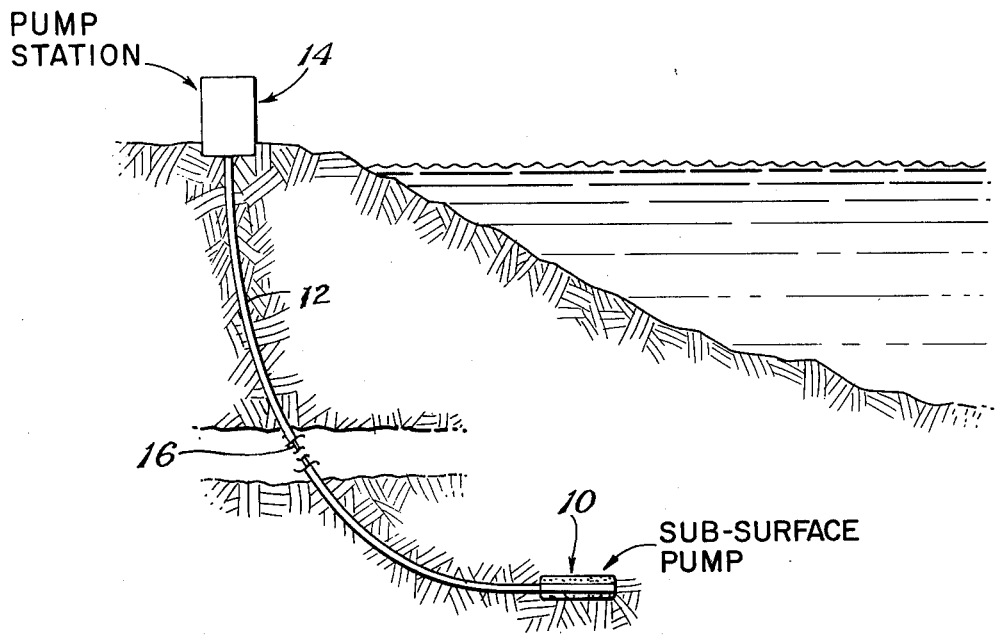
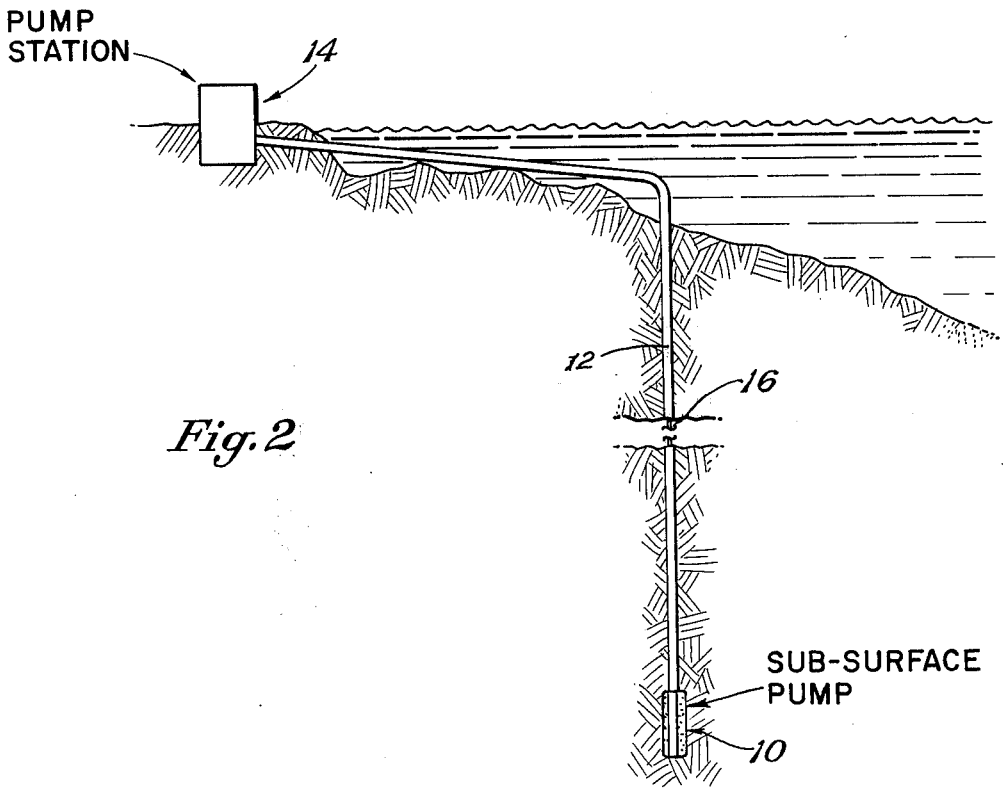
Fig. 2

DEEP WELL PUMP SYSTEM

BACKGROUND OF THE INVENTION

The present invention relates to new and useful improvements in lifting systems, such as deep well pump systems, for moving a commodity from a first location to a second location at a higher elevation than the first location. More particularly, the present invention is concerned with a unique pump system wherein a sub-surface pump is controlled from a ground surface power unit through the use of hydraulic pressure, avoiding the necessity of mechanical pump rods and the like.

Specifically, the system proposed herein in illustrated embodiments involves the utilization of a sub-surface pump unit incorporating a collapsible volume chamber, the collapse of which is resisted by resiliently compressible means, or spring means, therein; either a compressible inert gas such as nitrogen or a mechanical spring. The resistance to collapsing developed by the spring means is essentially equal to the pressure developed by the height of the fluid column plus the desired discharge pressure whereby the pump unit is, without the application of pumping pressure from the surface power unit, maintained at full discharge condition. The power unit is adapted to contain two volumes, each generally equal to the volume of the collapsible volume chamber within the pump unit. A discharge of one volume from the power unit through the fluid column to the pump unit effects a full charging stroke of the pump piston by a full collapsing of the collapsible volume chamber so as to accommodate the introduced single volume from the power unit and a corresponding introduction of a second volume, from the well, into the working chamber above the pump piston through the linear movement thereof induced by the collapse of the collapsible volume chamber. Continued movement of the power unit subsequent to discharge of the first volume, through the increased pressure, opens an exhaust valve for a discharge of the second volume from the power unit into fluid storage facilities. The return stroke of the power unit piston releases the pressure on the exhaust valve so as to close the flow to fluid storage and causes a reduction of pressure on the fluid column and within the pump unit itself so as to enable, through the action of the spring means associated with the collapsible chamber, expanding the collapsible chamber and effect a simultaneous linear return of the pump or working piston so as to discharge the accumulated two volumes from the pump unit back into the power unit.

The system as above described basically involves a relationship whereby any force applied on the fluid column over and above the discharge pressure is transferred by the fluid column to the charging chamber, causing a collapse in volume of the collapsible volume chamber associated therewith a proportionate volumetric amount. This, in turn, is converted to linear travel of the pump piston in the working cylinder. When the force above the discharge pressure is released, the system returns to its essentially balanced condition and discharges the amount of additional fluid displaced within the working cylinder. As a normal situation, to be set forth in more detail subsequently, the system contemplates the introduction of one volume from the power unit to the pump unit at a developed pressure of twice the discharge pressure so as to effect a return flow of two volumes at the discharge pressure, thus providing a highly efficient operating system utilizing practical, readily available and economical components in the accommodation of wells of substantial depth, up to 15,000 or more feet. In connection therewith, as noted supra, the spring means or a compressible gas such as nitrogen in the deeper wells, can serve as the counterbalance means described later hereinafter. Also, the valving in the present invention is much simplified over that in similar prior art for greater economy, efficiency and less maintenance.

The inventor is aware of the following prior art U.S. Pat. Nos. 736,062; 1,616;773; 2,058,455; 2,917,000; 3,015,280; 3,109,379.

Additional features, objects and advantages of the invention which will become subsequently apparent reside in the details of construction and operation as more fully hereinafter described and claimed. Reference is had to the accompanying drawings forming a part hereof wherein like numerals refer to like parts throughout.

BRIEF DESCRIPTION OF THE DRAWINGS

FIGS. 1 and 2 schematically set forth typical general environments of the invention.

DESCRIPTION OF PREFERRED EMBODIMENTS

Referring now more particularly to the drawings, FIGS. 1 and 2 illustrate typical installations emphasizing the off-set capability of the surface actuated deep well pump system wherein the sub-surface pump unit can be orientated either horizontally or at any angle thereto, the well bore 12 extending from the pump unit 10 to the surface mounted power unit 14. An appropriate delivery tube 16 will be provided between the pump unit 10 and the power unit 14 for a movement of the pumped fluid therethrough. While it is possible that, through appropriate sealing means, the well casing itself could function so as to retain the fluid column, this in all probability would only be possible in relatively shallow wells.

Figure 3:
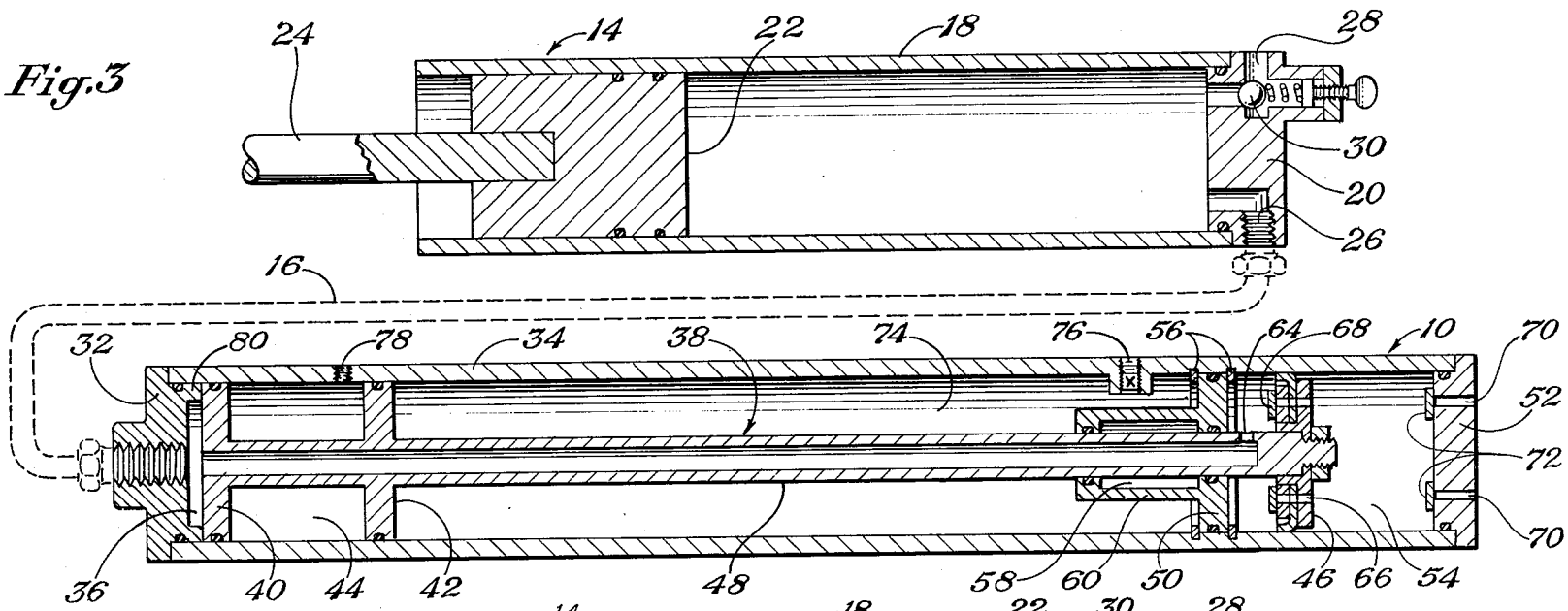
FIG. 3 is an enlarged cross sectional detail of the pump unit and power unit in their respective discharge and power release positions.

Referring now to FIG. 3, the surface located pump power unit 14 basically includes an elongated cylinder 18 closed at one end by a cylinder head 20 and receiving a sliding power piston 22 therein for travel between a fully retracted position adjacent the end of the cylinder 18 opposed from the cylinder head to a fully driven or charging position adjacent the cylinder head. An appropriate power driven rod 24 connects to the piston 22 for the reciprocal driving thereof. The cylinder head 20 includes a first port 26 to which the upper end of the fluid column forming pipe or tube 16 is sealed. A second port 28, comprising an exhaust port, is also provided through the cylinder head and leads to appropriate fluid storage means. This second port includes an adjustable spring-loaded internal exhaust valve 30 precluding outward flow from the cylinder 18 therethrough until such time as a predetermined pressure is achieved.

The second or lower end of the fluid column pipe or tube 16 is engaged with and sealed to the rear or upper end plate 32 on the cylindrical body 34 of the sub-surface pump unit 10. This tube 16 will normally suspend and support the pump unit 10 and constitute the only connection between the pump unit and the surface.

The fluid column tube 16 communicates with a charging chamber 36 through the end plate or cylinder head 32, this charging chamber 36 being located immediately inward of the plate 32. The pump housing or cylinder 34 includes an elongated piston unit 38 extending a major portion of the length thereof. This piston unit 38 includes a top or charging piston 40, an intermediate piston 42 spaced slightly therebelow so as to define an intermediate oil barrier 44, and a bottom or working piston 46 toward the lower portion of the housing 34. The pistons are rigidly interconnected by means of an elongated axially extending hollow delivery tube 48 of a diameter substantially less than that of the surrounding housing 34 with which the outer periphery of the pistons slideably engage in a sealed fluid tight manner.

An intermediate annular cylinder head 50 surrounds the delivery tube 48 above the lower or pump piston 46 and a sufficient distance inward from the bottom plate or head 52, closing the lower end of the housing 34, so as to provide a working chamber 54 capable of accommodating the full reciprocating movement of the lower piston 46. The intermediate cylinder head 50 is fixed in position by appropriate retaining rings 56 and slideably receives the delivery tube 48 therethrough. A second oil barrier 58 is provided about the delivery tube 48 upward from the intermediate cylinder head 50 by means of a tube surrounding sleeve 60, the lower end of which is sealed or integrally formed with the intermediate cylinder head 50 and the upper end of which is appropriately sealed to the delivery tube 48.

The upper end of the hollow delivery tube 48 opens directly into the charging chamber 36 with the passage of fluid therethrough being unobstructed by one way valve means. One or more fluid transfer ports 64 extend through the lower portion of the delivery tube 48 and communicate the interior of the delivery tube with that portion of the working chamber above the lower piston 46 and below the intermediate cylinder head 50. The extreme lower end of the delivery tube 48 is sealed to the piston 46 whereby no direct communication is provided to the working chamber 54 below the lower piston 46.

The lower piston 46 includes fluid transfer ports 66 therethrough with associated one way flap valves or the like 68 which, upon a downward movement of the piston 46, allow for an upward flow of fluid therethrough and which close upon an upward movement of the piston 46 so as to preclude a return or downward flow of the fluid, thus in effect trapping the fluid in the upper section of the working chamber for subsequent upward discharge through the delivery tube as shall be explained subsequently. The lower end plate or head 52 also includes fluid ports 70 and associated one way valves 72 for an inward drawing of fluid, in an obvious manner, in response to reciprocation of the piston 46. Appropriate seals will of course be provided as needed throughout the system.

The elongated chamber 74 defined between the intermediate cylinder head 50 and the slideable intermediate piston 42 located substantially thereabove is sealed and constitutes a collapsible volume chamber, the collapsing of which, upon the introduction of a predetermined volume in the charging chamber 36, is translated into linear movement of the working piston 46. Resistance to a collapsing of this chamber 74 will be provided for by an internal pressurization utilizing an appropriate compressible inert gas such as nitrogen pressurized to an operable pressure, which must counterbalance the pressure of the static fluid column plus provide any desired discharge pressure. An appropriate plugged pressurizing port and associated pressure check valve assembly 76 can be provided for communication with the collapsible volume pressure chamber 74. Likewise, an appropriate plug closed filler port 78 can be provided for communication with the upper oil barrier 44. 80 Constitutes a small annular stop shoulder limiting upward movement of the top or charging piston 40 to insure an exposure of the major portion of the upper face of this piston 40 at all times.

Referring now to the operation of the above described system, in the assembly as illustrated in FIG. 3, the pump unit 10 is in its full discharge position with the pressure in the charging chamber 36 being that developed by the static weight of the fluid column. The pressure in the delivery tube 48 and the upper and lower sections of the working chamber to the opposite side of piston 46 will be that of the well fluid within which the pump unit is submersed. The pressure within the collapsible volume chamber 74 is equal to that to counterbalance the force of the static fluid column plus the desired discharge pressure, for example 50 pounds per square inch (psi). In the surface power unit, the adjustable exhaust valve assembly will normally be set to open at an efficient operating pressure sufficient to effect the desired downward movement of piston 46; and, thereafter, vent the excess fluid to a sink, illustrated as port 28. Ordinarily, delivery pipe is connected with port 28 and to the sink, such as storage.

Figure 4:
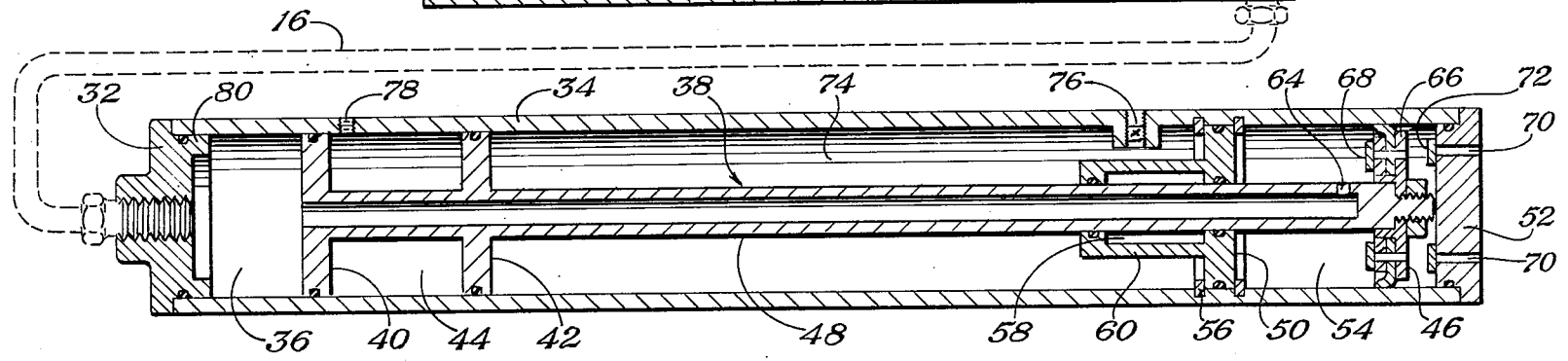
FIG. 4 is a view similar to FIG. 3 with the pump unit moved to the full charged position and the power unit with the piston therein at the point along its stroke sufficient so as to fully charge the pump unit.

Upon a forward driving of the power unit piston 22 and the application of working pressure, the pressure builds up in the charging chamber 36, causing a downward driving of the piston unit and a compressing or contracting of the volume of the collapsible volume chamber 74. This causes a linear downward movement of the working piston 46 and an upward flow of the well fluid through the fluid port or ports 66, past associated check valve 68, into the upper section or portion of the working chamber 54 above the piston 46. This continues until the bottom of the power downstroke is reached, for example by a bottoming of the slightly projecting end portion of the delivery tube 48 on the lower head 52. In this position, the volume displaced by the power unit piston 22 will be equal to the reduction in volume in the collapsible volume chamber 74 and equal to that introduced into the charging chamber 36. A substantially equivalent volume will have, at the same time, flowed upward through the ports 66 into the upper section of the working chamber 54 above the pump's piston 46. The orientation of the power unit and pump unit at this stage is illustrated in FIG. 4. It will be appreciated that, at this stage, the forcing of one volume from the power unit back into the pump unit has developed two trapped volumes within the pump unit. Preferably, at this stage of the pumping action, the power unit piston 22 will have moved approximately one-half of the length of the associated cylinder 18. At this point, the pressure developed in the power unit will have increased to that necessary for an opening of the exhaust valve assembly 30 whereby continued movement of the power piston 22 will exhaust the balance of fluid in the power unit to an appropriate fluid storage, thus readying the power unit cylinder 18 for reception of the two volumes developed in the pump unit 10.

Upon a retraction of the surface pressure, and a rearward drawing of the power cylinder 22, the exhaust valve assembly 30 closes and the release of the pressure in the charging chamber 36 enables a reexpansion of the compressible volume chamber 74 back toward the full discharge position of FIG. 3. This, in turn, results in the one way piston valve 68 closing, and in an exhausting of the fluid in the charging chamber 36 and the upper section of the working chamber 54 above the pump piston 46. At the same time, well fluid enters into the lower section of the working chamber 54 below the pump piston 46 through the valved ports 70.

As will be appreciated from the foregoing, the system operates basically on the principle of the introduction of one volume down the well at an initial pressure X and the return of two volumes at one-half the initial pressure or X/2. In other words, in order to obtain a specific discharge delivery pressure, it is necessary that the surface power unit apply approximately twice that pressure on the downstroke. A properly balanced pressurization should allow the entire fluid column to bounce and to obtain simple over-flow fluid delivery would simply require synchronization and sufficient power input to maintain a column bounce plus replacing the weight energy of the discharged fluid. Ideally, resonance can be induced through proper correlation of pumping frequency and column fluid length for even more efficient operation, particularly in the absence of a valve at the top of the hollow delivery tube 48 and piston 40. The surface power unit as illustrated allows the sub-surface pump unit to start downward at the beginning of the surface power stroke and start returning at the beginning of the surface power unit return stroke. At these points of travel, acceleration is slower and excess hydraulic shock is avoided.

The use of a collapsible volume chamber enables operation of the sub-surface pump unit based on volume displacement which, in turn, requires only the development of pressure sufficient so as to overcome the desired discharge pressure. The reactive force developed by the spring means, preferably an inert gas, such as nitrogen, in turn, need only be sufficient so as to counteract the force of the pressure of the fluid column plus the desired discharge pressure. The use of nitrogen is considered particularly significant in that the collapsible volume chamber 10, directly on location, can be charged to the required pressure, thus allowing for the accommodation of a wide range of different depth wells without any change in the basic apparatus such as would be required were mechanical springs or the like utilized. By the same token, substantially greater depth can be accommodated utilizing nitrogen.

The oil barriers 44 and 58 are specifically provided so as to keep the seals associated with the nitrogen containing chamber 74 from working against surfaces exposed to any abrasives such as might be encountered in the pumped fluids. As such, the height of these oil barriers must be greater than the desired working stroke of the piston unit.

Figure 5:
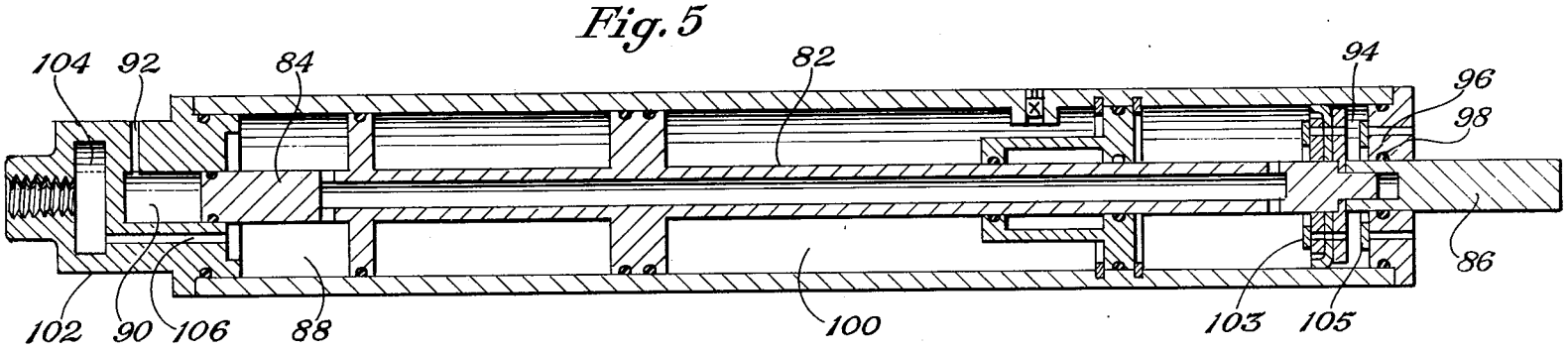
FIG. 5 illustrates a modified form of pump unit.

Referring now to the sub-surface pump unit of FIG. 5, it will be appreciated that the structure therein basically varies from that illustrated in FIG. 3 by a removal of the cross sectional area of the delivery tube or piston connecting rod 82 by the provision of upper and lower extensions 84 and 86. The upper extension 84 extends through the charging chamber 88 and is slideably received and sealed within a pressure relief chamber 90 having a relief port 92 therein. The lower extension 86 extends completely through the lower working chamber 94 and slideably through the lower plate or head 96, appropriate seals 98 of course being used. The intermediate internally pressurized collapsible volume chamber is, in this variation, designated by reference numeral 100. The upper head 102 includes a discharge accumulator chamber 104 directly communicated with the lower end of the fluid column tube and in turn communicated with the charging chamber 88 by appropriate transfer port means 106.

Operation of this particular pump unit will be the same as that set forth supra with regard to the pump unit of FIG. 3 and, while not specifically described, the necessary check valves 103 and 105 will be provided. Basically, this variation, by removal of the area of the discharge tube from the pressure receiving chambers, results in a more balanced condition such as might be required when a bounce pump action is used or when extreme well depths are encountered.

Figure 6:
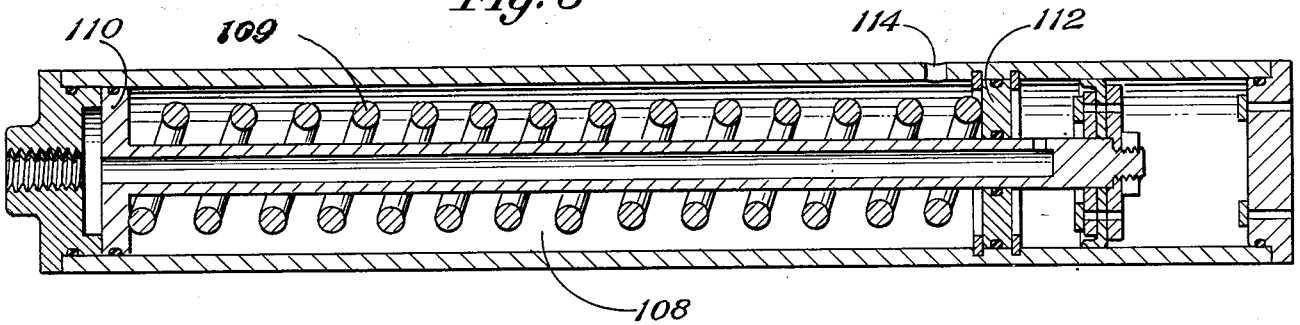
FIG. 6 illustrates a further variation in the construction of the pump unit.

FIG. 6 illustrates a further variation of the sub-surface pump unit particularly useful for relatively shallow wells of 1,000 feet or less in depth. In this variation, the collapsible volume chamber 108 incorporates an expanded coiled compression spring 109 engaged between the upper or charging piston 110 and the lower intermediate cylinder head 112. Appropriate breather ports 114 are provided into the collapsible volume chamber 108. Similarly as with the compressible gas, the spring must be capable of counterbalancing the force of the column of fluid even at its extended position on a fluid delivery stroke. The length of the spring will be that necessary to effect the desired stroke to deliver feasible volume at a respective diameter; all in accord with conventional pump design criteria. It is contemplated that for a 1,000 foot well, the spring would be up to several feet in length and would require a compression strength of approximately 3,000 pounds or more. The remainder of the components are substantially the same as those described in conjunction with the pump unit of FIG. 3 and the operation of the pump unit is identical to that described in connection with the unit of FIG. 3.

Figure 7:
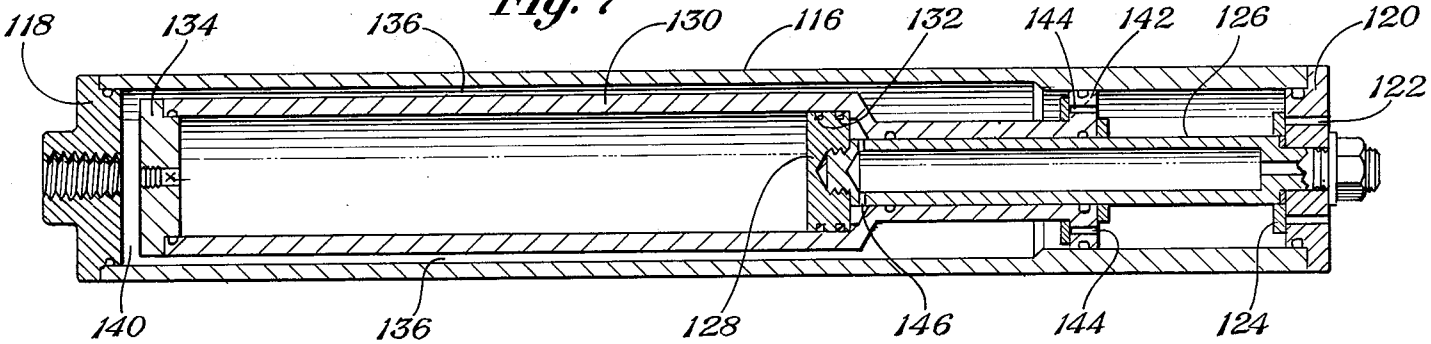
FIG. 7 illustrates yet another variation in the construction of the pump unit.

The pump unit embodiment of FIG. 7 includes an elongated cylindrical housing 116 having an apertured top plate or head 118 to which the lower end of the fluid column tube is sealed. The lower end of the housing 116 is closed by a bottom plate or head 120 having intake ports 122 therein along with associated one way check valves 124 allowing an upward intake of fluid but precluding a downward discharge thereof. An elongated rod 126 is affixed centrally to the head 120 and extends coaxially upward through the housing 116, terminating in an enlarged stationary piston 128. The piston 128 is received within an elongated cylinder 130 adapted to vertically reciprocate relative to the stationary piston 128, appropriate seals 132 being provided therebetween as required. The upper end of the movable cylinder 130 is closed by a pressure receiving head or piston member 134 which, in conjunction with the stationary piston 128, defines a collapsible volume chamber within the cylinder 130. Appropriate spring means, either an expanded coil compression spring as illustrated in FIG. 6 or pressurized nitrogen as illustrated in FIG. 3, is provided within the collapsible volume chamber. Flow passages 136 are provided between the cylinder 130 and the housing wall. The cylinder head 134 is, of course, sealingly fixed to the movable cylinder 130.

A sleeve like extension extends downwardly from the lower end of the cylinder 130 about the rod 126 and terminating in the pumping piston 142 which, similar to the previously described pumping pistons, includes check valve controlled fluid ports 144 for a transfer of the fluid from the lower portion of the working chamber to the upper portion thereof during the stroking of the pump. If deemed desirable, the rod 126 can open at the lower end to the well fluid and include breather ports 146 communicating with the interior of the cylinder 130 immediately below the stationary piston 128 so as to reduce any tendency for a vacuum to form.

Operation of this form of pump unit will also be substantially the same as that described supra with regard to the form of FIG. 3. Basically, the introduction of a sufficient volume within the charging chamber 140 so as to collapse the collapsible volume chamber above the stationary piston 128 will result in the simultaneous accumulation of an equal volume in the upper portion of the working chamber above the downwardly shifted pumping piston 142. A release of the surface pressure will allow for a reexpansion of the collapsible volume chamber for an upward driving of the fluid from the charging chamber 140 and the substantially equal volume from the upper portion of the working chamber. Thus, through the utilization of the internal collapsible volume chamber, two volumes of fluid are returned for each single volume of fluid introducted downward into the pump unit. As will be appreciated, in this pump unit, as in the above described pump units, the volume accumulated in the working chamber for discharge upward is substantially equivalent to the volume introduced into the charging chamber and the volumetric decrease in the collapsible volume chamber.

From the foregoing, it can be seen that, broadly, the present invention includes a lifting system for lifting a commodity from a source at a first location to a sink at a second location higher than the first location so there is at least a lift head that must be overcome. The lift system includes:

an enclosed passageway for movement of the commodity from the source to the sink;

a source unit connected with the passageway and having a piston means for lifting the commodity from the source to the sink against the lift head;

a counterbalance means connected with the source unit and operably disposed to counterbalance the force exerted by the lift head on the source unit downstream of a discharge valve means;

a power input unit connected with the source unit for supplying power not supplied by the counterbalance means for lifting the commodity;

intake valve means for effecting intake of the commodity into the source unit and adapted to withstand the pressure at the bottom of the passageway on a downstroke of the piston means of the source unit; and discharge valve means for effecting discharge of the commodity from the source unit into the passageway; the discharge valve means being operable to effect discharge of the commodity from the source unit into the passageway at substantially the pressure prevailing at the bottom of the passageway and opening at the intake stroke of the piston for intake of said commodity at the bottom pressure.

The foregoing is considered illustrative only of the principles of the invention. Since modifications and variations may occur to those skilled in the art, it is not desired to limit the invention to the exact construction and operation shown and described. Accordingly, all suitable modifications and equivalents may be resorted to, falling within the scope of the invention as claimed.

What is claimed is:

1. In a surface pressure activated deep well pump system, a sub-surface pump unit and a surface power unit, a fluid delivery passage between the pump unit and the power unit, the depth of the pump unit defining a predetermined fluid column within the fluid delivery passage upward from the pump unit, said pump unit comprising a housing including an activating chamber, a discharge port communicating the activating chamber with the fluid delivery passage, a charge piston defining a wall of said activating chamber, said charge piston being slideably movable between a full discharge position and a full charge position, a valve intake through the housing, a working chamber within said housing remote from the activating chamber and in communication with the intake, a working piston sildeably disposed within said working chamber for a selective inward drawing of fluid through said intake and a selective discharge of fluid through said discharge port, means interconnecting the charge piston and the working piston for synchronized movement, a collapsible volume chamber resiliently retaining said charge piston in the full discharge position, said collapsible volume chamber developing a resistance to movement approximately equal to the pressure of the fluid column plus a predetermined fluid discharge pressure, said power unit being operable to pressurize said fluid column above the predetermined fluid discharge pressure to collapse the collapsible volume chamber and effect a fluid trapping movement of the working piston, said power unit being subsequently operable to reduce pressure on the fluid column below the predetermined fluid discharge pressure to allow an expansion of the collapsible volume chamber and a discharge of fluid trapped by the working piston; a sealing chamber containing a liquid barrier disposed intermediate a pair of seal means at the respective ends of said collapsible volume chamber at which there is relative reciprocal motion for preventing entry of abrasive materials into said collapsible volume chamber.

2. In a surface pressure activated deep well pump system, a sub-surface pump unit and a surface power unit, a fluid delivery passage between the pump unit and the power unit, the depth of the pump unit defining a predetermined fluid column within the fluid delivery passage upward from the pump unit, said pump unit comprising a housing including an activating chamber, a discharge port communicating the activating chamber with the fluid delivery passage, a charge piston defining a wall of said activating chamber, said charge piston being slideably movable between a full discharge position and a full charge position, a valve intake through the housing, a wording chamber within said housing remote from the activating chamber and in communication with the intake, a working piston slideably disposed within said working chamber for a selective inward drawing of fluid through said intake and a selective discharge of fluid through said discharge port, means interconnecting the charge piston and the working piston for synchronized movement, a collapsible volume chamber resiliently retaining said charge piston in the full discharge position, said collapsible volume chamber developing a resistance to movement approximately equal to the pressure of the fluid column plus a predetermined fluid discharge pressure, said power unit being operable to pressurize said fluid column above the predetermined fluid discharge pressure to collapse the collapsible volume chamber and effect a fluid trapping movement of the working piston, said power unit being subsequently operable to reduce pressure on the fluid column below the predetermined fluid discharge pressure to allow an expansion of the collapsible volume chamber and a discharge of fluid trapped by the working piston; the collapsible volume chamber comprising a vertical and movable cylinder disposed within said activating chamber and said working chamber and reciprocally engaging a fixed piston; said movable cylinder being rigidly attached to said working piston; said movable cylinder having a charging means for charging with a compressible fluid and having imperforate exterior and inflexible walls for sustaining a predetermined pressure therewithin without extrusion problems regardless of depth of the well.

* * * * *